US005439122A

United States Patent [19]

Ramsay

[11] Patent Number: 5,439,122

[45] Date of Patent: Aug. 8, 1995

[54] PRODUCT DISPLAY RACK

[75] Inventor: Arlen R. Ramsay, Roswell, Ga.

[73] Assignee: Miller/Zell, Inc., Atlanta, Ga.

[21] Appl. No.: 176,528

[22] Filed: Jan. 3, 1994

[51] Int. Cl.[6] ..... A47F 5/00

[52] U.S. Cl. ..... 211/187; 211/128

[58] Field of Search ..... 211/187, 128, 153, 193, 211/90, 134; 108/144, 111

[56] References Cited

U.S. PATENT DOCUMENTS

| | | | |
|---|---|---|---|
| 3,280,989 | 10/1966 | Melvin et al. | 211/187 X |
| 3,777,897 | 12/1973 | Gray | 211/128 X |
| 4,669,692 | 6/1987 | Mastrodicasa | 211/187 X |
| 4,776,472 | 10/1988 | Rosen | 211/187 |
| 4,790,707 | 12/1988 | Magretta et al. | 211/187 X |
| 5,119,945 | 6/1992 | Wiggins | 211/90 X |

*Primary Examiner*—Leslie A. Braun
*Assistant Examiner*—Sarah L. Purol
*Attorney, Agent, or Firm*—Hopkins & Thomas

[57] ABSTRACT

A product display rack for stocking and displaying products for sale, including a pair of upright stanchions having a series of laterally extending shelf supports attached thereto. Shelf assemblies are slidably mounted on the shelf supports such that the shelf assemblies can be moved from a retracted display position to an extended stocking position displaced from the stanchions. Better access to the rearward portions of the shelf assemblies is provided to enable efficient restocking of newer products rearwardly of older products on the shelf members without requiring removal of the older products prior to restocking.

14 Claims, 3 Drawing Sheets

PRODUCT DISPLAY RACK

FIELD OF THE INVENTION

The present invention relates generally to a product display rack that enables fresh products or merchandise to be quickly and easily stocked behind older product displayed on the rack. More particularly, the invention comprises a product display rack having a series of shelves for supporting rows of prepackaged products or merchandise for sale. The shelves are slidably mounted on shelf supports so that the shelves can be moved from a retracted display and storage position into an extended restocking position displaced outwardly from the other shelves of the rack or its retracted position. The shelves, therefore, can be selectively exposed to permit better access to the rearward portions of the shelves. Using the present invention readily enables the cycling of older product forwardly and the restocking of the shelf with newer products behind the older product with greater speed and efficiency.

BACKGROUND OF THE INVENTION

To successfully promote and sell virtually any product, it is important for retailers and in-store merchandisers to display the product efficiently and attractively to potential purchasers. It is well known that a successful promotion and sales campaign for products depends in large part on the display of the product in-store, which is how most purchasers commonly view the product. The manner in which products are actually displayed, either overtly or subliminally, can increase or decrease the likelihood that a purchaser will select that product. Thus, in-store or "point of purchase displays" must be carefully designed to attract and entice potential purchasers to view and purchase such products.

Another critical problem facing retailers and "in-store" merchandisers is the need to sell older products first, and newer, fresher products thereafter. This is especially a problem in the merchandising and sale of perishable goods, such as chips and other snack products, which are freshness dated. This also applies, however, to other, non-food products which have a finite shelf life, such as batteries and certain chemical products. Given the substantial investment that most retailers and merchandisers have in their stock of merchandise, it is important for such retailers and merchandisers to sell the older or earlier dated products first, before these products must be discarded due to being stale or unusable for their intended purpose. Further, laws in some areas require that certain products not be sold after a certain date is reached. It is necessary, therefore, for retailers or other merchants, when restocking product displays, to backload or stock such displays with the newer product positioned behind the older product so that the older product is first presented for sale.

Backloading or restocking of product from the rear is not, however, easy to accomplish with most conventional shelf display assemblies. Fixed shelf or basket-type display assemblies are used as a preferred means for stocking products for display and sale. To restock such shelves or baskets with new product, however, it is often necessary first to remove the older product completely from the shelf before the fresher product can be stocked at the rear of the shelf, and the older product then replaced in front of the fresher product so that the older product is sold first.

As a result, the time required to restock such shelf or basket-type displays with product is greatly increased. Consequently, the labor costs associated with the restocking of products on such displays are increased, and the productivity of workers restocking these shelves is decreased as the number of stores and/or display units that can be serviced by each worker is limited by the time required for restocking these displays.

Further, it is common that the distributor of a product has the responsibility of restocking product displays, and thus is the entity that incurs the costs of restocking, rotating stock, and organizing displays. Such a "direct delivery" method of servicing displays generally is accomplished by organizing customers into "routes", each route serviced by a specific delivery person. Considering that a distributor's customers often are large distances apart, time is generally of the essence in efficiently maintaining product displays along a predetermined route. The time required for restocking product displays thus also affects the number of customers that can be serviced by a particular delivery person, and as a consequence, affects the size of a particular route and the number of delivery persons necessary to service all of the distributor's customers.

Accordingly, it would be desirable to provide a shelf-type or basket-type point of purchase display that permits quick and efficient restocking of newer product rearwardly of older product on the display without requiring the removal of older products prior to restocking, to reduce the labor costs of maintaining product displays and to increase the likelihood that products will be efficiently and attractively presented for purchase by customers.

SUMMARY OF THE INVENTION

The present invention generally comprises a shelf or basket-type product display assembly or rack for stocking and displaying products, including but not limited to perishable bags of food products and other prepackaged goods. The display rack includes a pair of upright stanchions, each preferably formed from steel tubing or other similar rigid, high strength material. The stanchions each have an upper end and a lower end and are positioned in a spaced apart parallel upstanding relationship. Cross braces are attached to a rearward side surface of each stanchion, attaching the stanchions together and helping maintain the stanchions in their parallel upright attitude.

Supports or foot members are mounted to the stanchions adjacent their lower ends. The foot members generally are L-shaped braces having vertically oriented sections mounted to the lower ends of the stanchions, and horizontally oriented sections that extend away from the lower ends of its stanchion, perpendicular to the stanchions. The horizontal portion of each foot member engages and rests upon the floor of a store in which the product display rack is used for supporting each stanchion.

A series of mounting bores or holes are defined in the front surface of each of the stanchions. The mounting bores generally are arranged in pairs at spaced intervals along the length of each stanchion. The pairs of mounting bores of each stanchion are each horizontally aligned with a pair of mounting bores of the other stanchion. Shelf supports are received within the mounting bores in locking engagement for mounting the shelf supports to the stanchions. Each shelf support generally is a U-shaped rod having upper and lower sections with an open-ended slot formed between the upper and lower sections. The free end of the upper section has a stepped or Z-shaped configuration, while the free end of the lower section extends substantially straight. The shelf supports are locked into engagement with a stanchion by insertion of the free ends of the upper and lower sections of the supports into a respective pair of mounting bores, with a portion of the Z-shaped ends of the upper sections engaging an inner side wall of the stanchion to secure the shelf support within its stanchion. In this manner, the supports extend outwardly from the stanchions, and are securely held thereto in cantilever fashion.

A plurality of shelf assemblies are slidably mounted upon pairs of horizontally aligned shelf supports, so that each shelf is maintained in a horizontal position with respect to the vertically upstanding stanchions. Each shelf assembly is a substantially rectangularly shaped plate formed from molded plastic material, although other substantially rigid materials can be utilized as desired. Each shelf assembly has an upper surface on which products are displayed, and a substantially flat lower surface. Shelf guides are rigidly attached to or positioned on the lower surfaces of the shelf assemblies, extending substantially across the width thereof normal to the associated stanchion out parallel to the associated support. Each guide generally is a C-shaped sleeve having a pair of downwardly extending side walls defining an open ended channel or slot. The guide channel can be formed so that the open channel defined by the side walls extends sidewise or at an angle, other than downwardly, as is shown for ease of illustration.

The shelf supports are received within the guide slots of the guides for supporting the shelf assemblies thereon. As a result, the shelf assemblies are movable laterally from a retracted, display position adjacent the stanchions for storing and displaying products, to an extended stocking position displaced outwardly, laterally from the stanchions and other shelf assemblies. Such movement of the shelf assemblies enables substantially complete access to the upper surface of the shelf assemblies to facilitate the restocking of newer, fresher product behind the older, more dated product.

Fasteners are extended through the parallel guides of each shelf assembly and through the channels or slots of the shelf supports. The fasteners serve to slidably attach the shelf assemblies to their shelf supports, while still enabling sliding movement of the shelf assemblies along the length of the shelf support. The fasteners, however, prevent the shelves from being inadvertently displaced from the shelf supports.

In an additional embodiment of the present invention, the shelf assemblies can be replaced with baskets comprising a lattice of metal wires or rods. Guides are attached to the lower surfaces of the wire baskets. The guides are generally C-shaped sleeves formed from metal, and are welded to a laterally extending wire of the wire basket. Each of the guides has a pair of downwardly extending side walls defining an open ended slot or channel in which a shelf support is received. Pins or rods are welded to edges of the side walls of the guides, extending across the guide slots to prevent the shelf supports from becoming inadvertently disengaged from the guides.

The modular components of the present invention permit the invention to be readily assembled or disassembled, which is an advantage often needed by merchandisers, so that the unit can be moved or taken down easily and with minimal labor.

Accordingly, it is an object of the present invention to provide a product display assembly which readily permits newer, fresher product to be stocked behind older product.

Another object of this invention is to provide a product display assembly having movable shelf assemblies that can be moved to a stocking position displaced from the product display assembly to permit easy access to the shelf assemblies to enable efficient loading and restocking of product thereon.

Another object of the present invention is to provide a product display assembly which displays the products in a manner that decreases the time and labor needed to adequately stock and maintain the assembly.

Another object of the this invention is to provide a product display rack that can be easily assembled or disassembled in existing merchandising outlets without requiring special tools for construction.

Other objects, features and advantages of the present invention will become apparent from the following detailed description when taken in conjunction with the accompanying drawings, wherein like characters of reference designate corresponding parts throughout the several views.

DETAILED DESCRIPTION OF THE PREFERRED EMBODIMENTS

Figure 1:
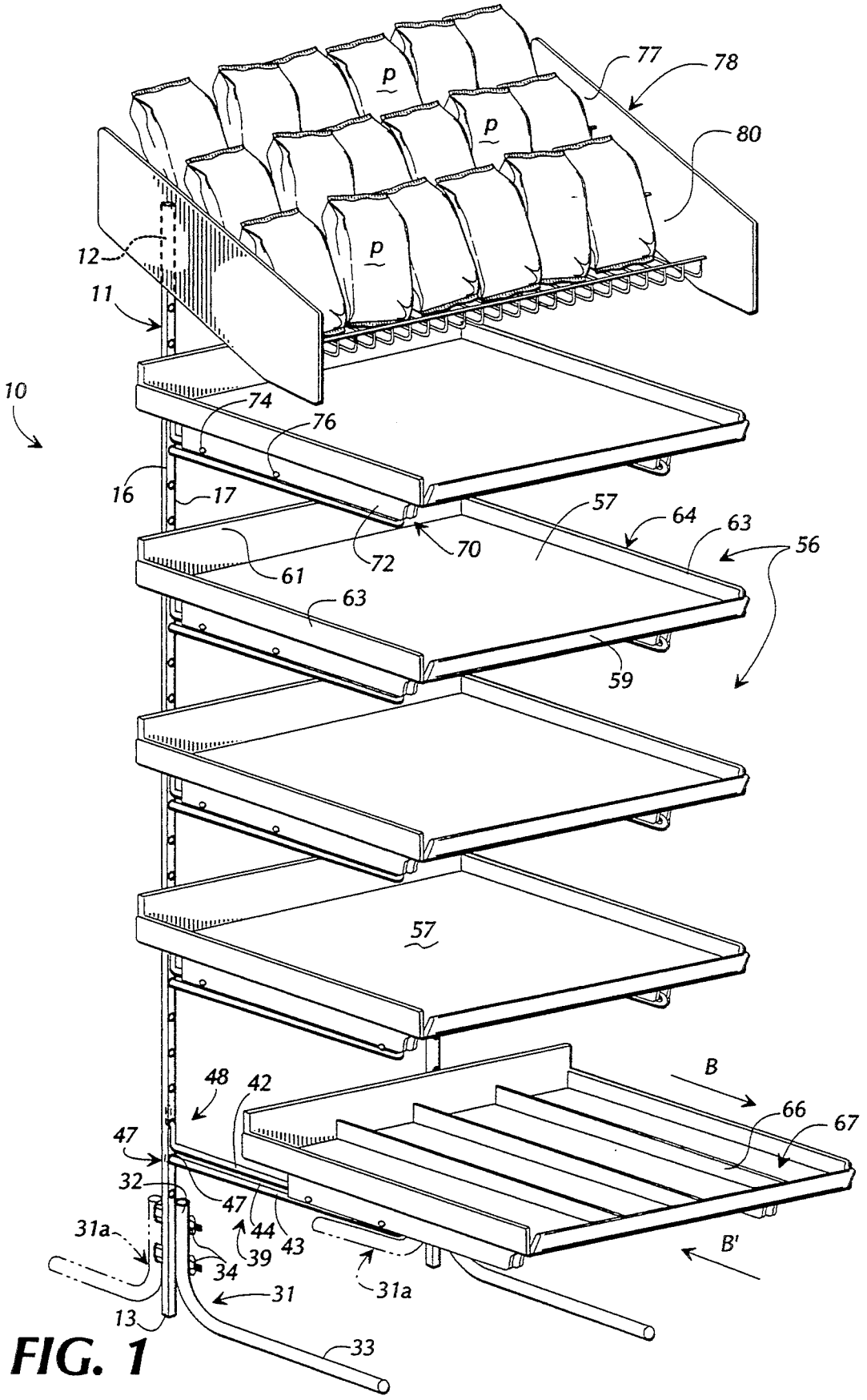
FIG. 1 is an elevational, perspective view of one embodiment of the present invention showing the lowermost shelf member in its extended stocking position for restocking of the shelf assembly with new product.

Referring now to the embodiments chosen for the purpose of illustrating the present invention, FIG. 1 illustrates a product display assembly or rack 10. The product display rack 10 includes a pair of vertically oriented stand members or stanchions 11 positioned in a spaced, parallel relationship. The stanchions typically are square or rectangularly shaped beams or round tubes generally formed from one inch steel tubing cut to a desired length corresponding to the preferred elevation of the product display rack 10. Each stanchion has an upper end 12 and a lower end 13. Square or rectangular stanchions include four side walls or surfaces 14, 16, 17, and 18. The stanchions 11 define throughout their lengths, elongate, hollow channels 15.

Figure 2:
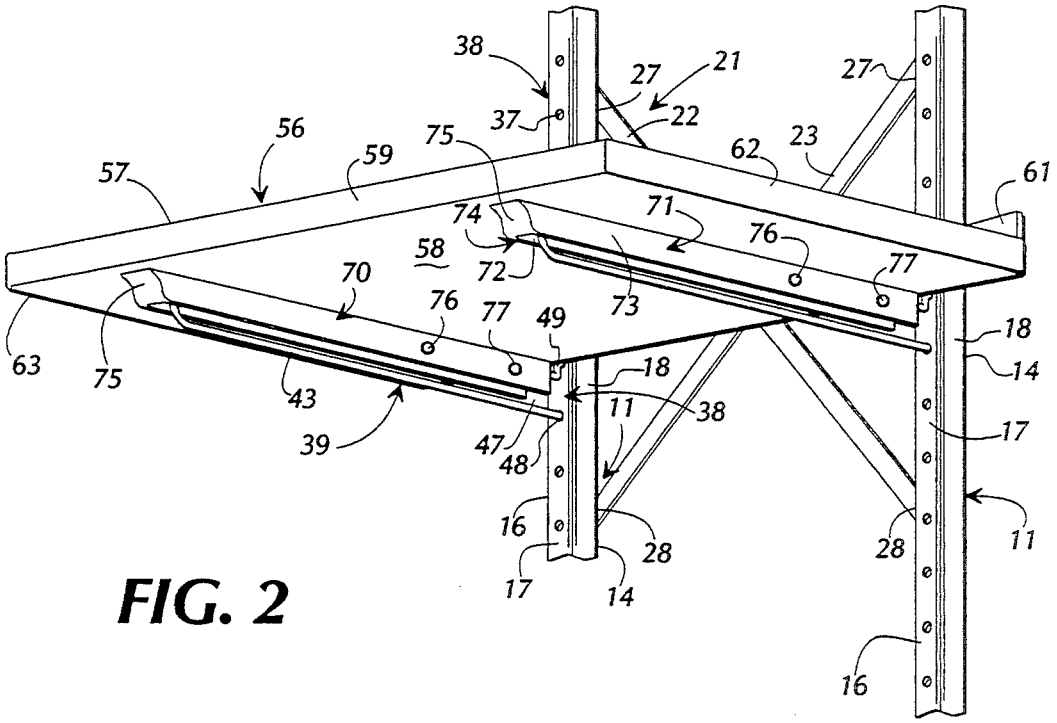
FIG. 2 is an elevational, perspective view of the underside of one of the shelf means of the display assembly.

As illustrated in FIG. 2, a cross brace assembly 21 is mounted to each stanchion, attached to rearwardly facing side surfaces 14 thereof. The cross brace assembly includes a pair of straps 22 and 23, generally formed from a metal such as steel or aluminum. The straps extend diagonally between the stanchions, crossing one another in a substantially X-shaped configuration. Each strap includes an upper end 27 attached to a first stanchion, and a lower end 28 attached to a second stanchion. The straps thus attach and support the upright stanchions in their parallel, upstanding relationship spaced from one another.

As FIG. 1 illustrates, base supports, such as foot members 31 are attached to the stanchions 11 at the lower ends 13 thereof. The foot members 31 generally are substantially L-shaped rods or braces, each having a vertical portion 32 that extends substantially parallel to the stanchions 11, and a horizontal portion 33 that extends in a direction normal to the length of the stanchions. The horizontal portions are adapted to engage and rest upon the floor of a retail store or similar environment in which the product display rack 10 is assembled and used. Fasteners 34 such as bolts, rivets or other similar types of fasteners are extended through the vertical portions 32 of the foot members and through the stanchions to secure the foot members to the stanchions. The foot members provide support and stability to the stanchions for supporting the stanchions in their vertically oriented attitude, and need only be of a length along portion 33 so as to adequately support rack 10. Optionally, a second base support 31*a* can be mounted to each stanchion 11 opposing supports 31, as shown in FIG. 1, if stability requirements dictate.

As shown in FIGS. 1 and 2, a series of mounting bores 37 are defined along the length of the stanchions 11, generally being formed through forwardly facing side surface or wall 16 so as to allow an object to be inserted into channel 15 therethrough. It will be further understood that the mounting bores can be formed through other side wall 17 or 18 instead of side wall 16. The mounting bores 37 are substantially circular openings formed in the stanchions 11, and generally are arranged in associated pairs 38, with each pair of mounting bores of each stanchion horizontally aligned with a similarly associated pair of mounting bores formed in the other stanchion.

Figure 3:
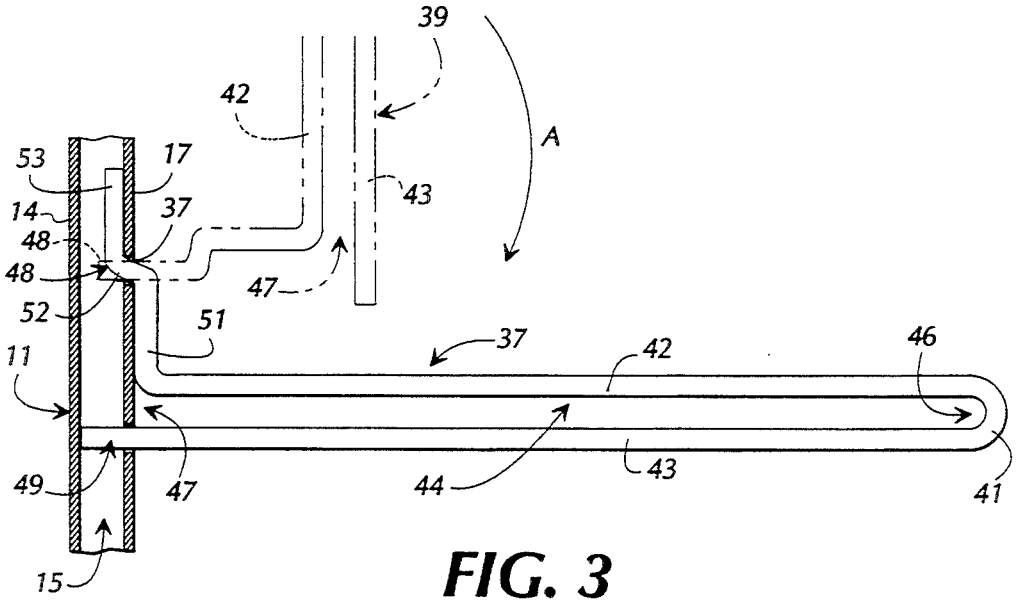
FIG. 3 is a partial, cross-sectional view of the display assembly, illustrating the locking engagement of a shelf support with a stanchion and showing in phantom lines the initial engaging position of the support with the stanchion.

As FIGS. 1, 2, and 3 illustrate, mounting struts or shelf supports 39 are adapted to be received within each pair 38 of mounting bores 37 so that the shelf supports 39 are securely mounted to the stanchions 11 in a locking relationship. As FIG. 3 shows, each shelf support generally is a U-shaped rod or wire loop having a bend 41 formed approximately in the center thereof, forming an upper section 42 and a lower section 43. An open-ended slot 44 is formed between the upper and lower sections, having a closed end 46 formed by the bend 41 and an open end 47 formed between free ends 48 and 49 of the upper and lower sections. FIG. 3 also illustrates the free end 48 of upper section 42 of each shelf support 39, which has a stepped or substantially Z-shaped configuration, and includes a first vertical portion 51 that extends upwardly in a direction normal to the length of the upper section 42, a downwardly angled midportion 52, and a second vertical portion 53 that extends upwardly from angled portion 52, substantially parallel to first vertical portion 51.

Each shelf support 39 is releasably attached to its associated stanchion by inserting first vertical portion 51 into the uppermost mounting bore of an associated pair of mounting bores formed in the stanchion, with the shelf support generally oriented approximately parallel to the stanchion, as shown in phantom lines in FIG. 3. In this manner, the free end 48 will be inserted through a bore and into channel 15. The shelf support thereafter is pivoted downwardly in the direction of arrow A, urging the angled portion 52 of free end 48 through the uppermost mounting bore, and moving free end 49 of the lower section 43 into the lowermost mounting bore of the associated pairs of mounting bores. As a result, the vertical portion 51 of free end 48 engages the inside side wall of the stanchion within channel 15 so as to lock the shelf support within the stanchions.

As shown in FIGS. 1 and 2, shelf assemblies 56 are slidably mounted upon horizontally associated, parallel pairs of shelf supports 39, attached to opposing stanchions 11 at varying elevations. Each shelf assembly generally is a substantially rectangularly shaped plate having an upper surface 57 on which products, such as prepackaged chips or other products P, are supported and displayed, and a lower surface 58. Each shelf assembly further includes an upstanding front edge 59, an upstanding rear edge 61 and upstanding side edges 62 and 63 which define a substantially rectangular product display area 64 on the upper surfaces of each shelf assembly. While the shelf assemblies can be plastic, unitarily formed by injection molding, metal shelves or those comprised of other durable materials also are suitable.

As shown in FIG. 1, a series of partitions 66 are formed at spaced intervals across the width of the shelf assemblies 56, extending between the front and rear edges 59 and 61, and substantially parallel to side edges 62 and 63. The partitions form troughs or product receptacles 67 on the upper surfaces 57 of the shelf assemblies 56. The product receptacles 67 enable the products P to be stacked in ordered rows and prevent the products from shifting or commingling, to help maintain an ordered appearance of the products.

As FIG. 2 illustrates, parallel shelf assembly guides 70 and 71 are formed along the lower surface 58 of each shelf assembly 56. The guides 70 and 71 are generally elongate, downwardly opening, substantially C-shaped sleeves formed in the lower surfaces of the shelf members with the formation of the shelf assemblies. Alternately, the guides can be formed as separate elements and attached to surface 58 in parallel relationship. Each guide includes a pair of downwardly extending parallel spaced side walls 72 and 73. The side walls define guide slots or channels 74 extending along the length of the respective guides. The guide slots are of a width slightly greater than the diameter of the shelf supports received therewithin to slidably mount the shelf assemblies to the shelf supports. The guides also can include a buttress or stop 75 located at any position between side walls 72 and 73. FIG. 2 shows stop 75 positioned between the outermost end portions of the associated side walls 72 and 73.

As FIG. 2 illustrates, fasteners 76 and 77 are extended through the side walls 72 and 73 of each guide 70 and 71 and through the slots 44 formed between the upper and lower sections of the shelf supports. The fasteners 76 and 77, such as pins or bolts, secure the shelf assemblies to the shelf supports so that while the shelf assemblies can still slide along the shelf supports, the shelf assemblies are restrained against inadvertent removal therefrom. To remove the shelf assemblies for cleaning or replacement, pins 76 and 77 are first removed. These fasteners further limit the forward travel of the shelves as shown in FIG. 1, by the engagement of fasteners 76 with the closed ends 46 of the shelf supports on which each shelf assembly is mounted.

Additionally, it is further possible to utilize a substantially L-shaped rod in place of the U-shaped shelf support. Such a support generally would include a substantially Z-shaped proximal end adapted to engage a mounting bore formed in one of the stanchions in locking relationship as discussed above, and a hooked or bent distal end displaced laterally from the stanchions. The fasteners of the guides of the wire baskets tend to engage the hook shaped distal ends as the wire basket is slid outwardly from the stanchions, to limit the travel of the wire baskets and prevent the wire baskets from being pulled off of the ends of the shelf supports.

As FIG. 1 illustrates, the product display rack 10 can further include a multi-tiered display basket 78 mounted to the upper ends 12 of the stanchions 11. The display basket 78 typically is a conventional basket type display formed from wire and includes multiple tiers 79 and 80 for displaying products in a cascading fashion.

Figure 4:
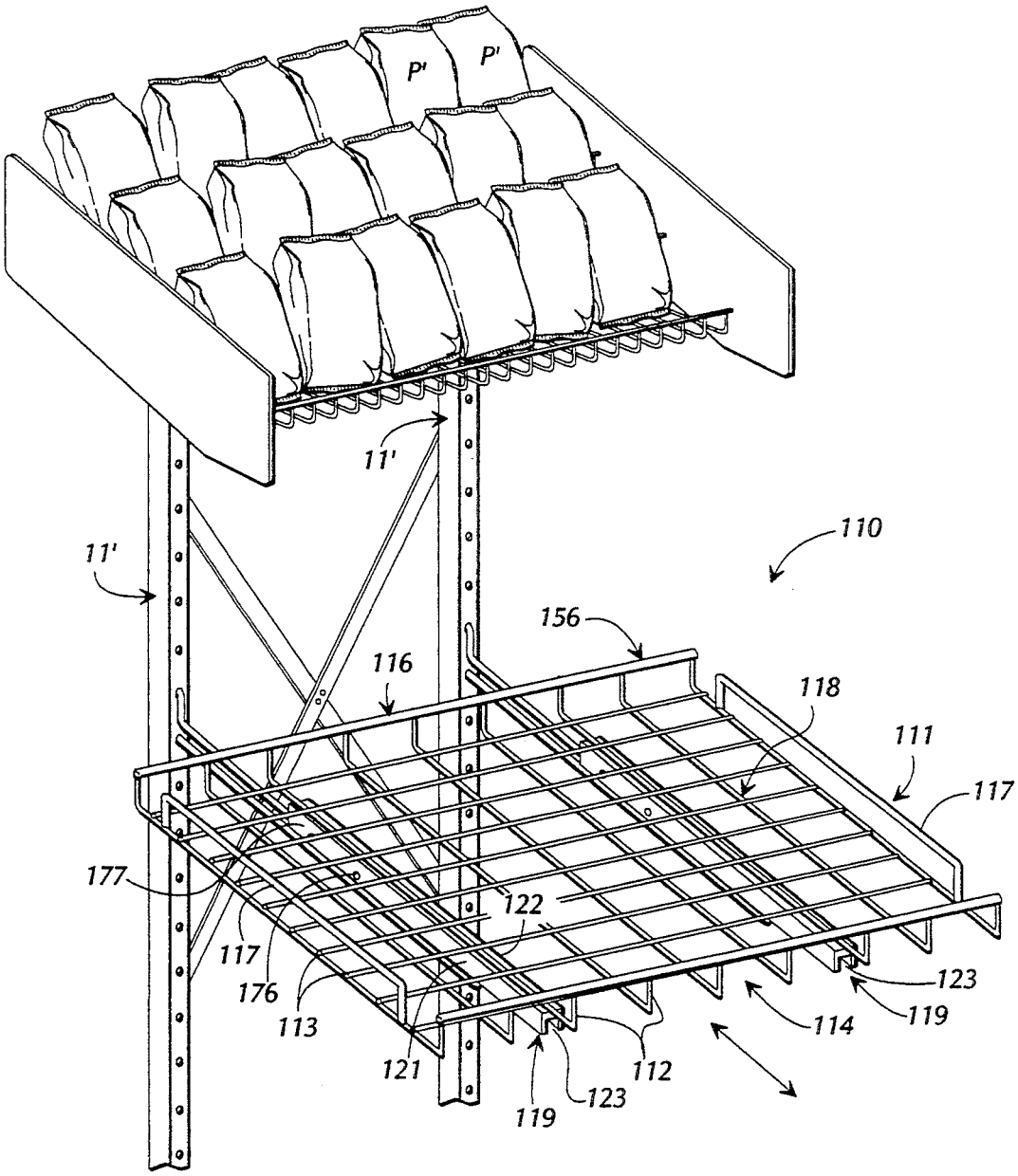
FIG. 4 is an elevational, perspective view of an alternate embodiment of the present invention, illustrating the use of a basket-type shelf.

FIG. 4 illustrates an additional embodiment of the rack 110. This embodiment is identical to that discussed above with respect to all elements, except for the shelf assemblies. In this embodiment, the shelf assemblies 156 each generally comprise a wire basket 111 formed from a lattice of longitudinally extending wires 112 and laterally extending wires 113. Each wire basket 111 further includes a front portion 114, rear portion 116, and side rails 117 defining a product receptacle or display area 118.

Parallel guides 119 are attached to the lower side surfaces of the laterally extending wires 113. The guides each comprise elongate, downwardly opening, substantially C-shaped sleeves having downwardly extending side walls 121 and 122 defining a guide slot or channel 123 in which shelf supports 39', identical to supports 39, are received to slidably mount the wire baskets toward and away from the stanchions 11'. Pins or fasteners 176 and 177 pass through side walls 121 and 122, respectively, of the guides 119 to secure the wire baskets to the shelf supports so that the wire baskets can slide along the length of the shelf supports between a retracted display position adjacent the stanchions and extended restocking position displaced from the stanchions and other wire baskets of the product display rack 110.

In operation and use of the product display rack 10, the product display rack is assembled by first positioning stanchions in a parallel spaced arrangement, resting upon their foot members or base supports. Cross brace 21 is thereafter attached to rearwardly facing side surfaces 14 of the stanchions 11 to secure the stanchions in a parallel spaced upstanding relationship. Shelf supports 39 are inserted into associated pairs 38 of mounting bore 37 formed along forwardly facing side surfaces 16 of the stanchions 11.

As shown in FIG. 3, the shelf supports 39 are attached to the stanchions by first inserting vertical portion 51 into the uppermost mounting bore of a pair of mounting bores until horizontal portion 52 engages side surface 16. The shelf support thereafter is pivoted downwardly in the direction of arrow A, which tends to urge angled portion 52 through the uppermost mounting bore and tends to direct the free end 49 of the lower section 43 of the shelf support into the lower mounting bore of the pair of mounting bores 38. The pivoting of the shelf support further tends to cause vertical portion 51 to engage the inner side wall of the stanchion 11 within channel 15, and vertical portion 53 to engage forwardly facing side surface 17 of the stanchion to releasably attach the shelf support 39 in secure frictional engagement with the stanchion.

Shelf assemblies 56 are thereafter positioned upon pairs of horizontally aligned shelf supports, with the shelf supports received within the guides slots 74 of guides 70 and 71 formed along the lower surfaces 58 of the shelf assemblies 56. Fasteners 76 and 77 are extended through the side walls 72 and 73 of the guides, projecting through the slots 44 formed between the upper and lower sections 42 and 43 of the shelf supports 39 to secure the shelf assemblies to the shelf supports. The shelf assemblies 56 are then loaded with products P, with the products arranged in distinct and ordered rows along product receptacles 67, to provide the products with an attractive and ordered appearance for sale.

As products are removed from the shelf assemblies by purchasers, the stock of product thereon is depleted. To restock the shelf assemblies with product, as shown in FIG. 1, the shelf assemblies are slid along the shelf supports 39 in the direction of arrow B from their retracted display position adjacent the stanchions 11, and into an extended stocking position displaced from the stanchions. This movement of the shelf members enables a worker access to the rearward portions of the shelf assemblies so that the older product on the shelf assemblies can be quickly and easily cycled forwardly, and new, fresher products can be stocked behind the older product without requiring the complete removal of the older product prior to restocking. Thus, the shelf assemblies are quickly and easily restocked with product, but the older product is first presented to customers so that it generally will be purchased before the newer product, to avoid expiration and waste of product. Once the shelf has been fully restocked, it is urged in the direction of arrow B', and slid back into its normal display position adjacent the stanchions, so as to be aligned with the other shelf assemblies of the product display rack.

Accordingly, it can be seen that the present invention provides a product display rack that enables quick and easy access to the rearward portions of the shelf assemblies of the display so that newer product can be restocked behind older, more dated product, without requiring the older product be first removed from the shelves to facilitate the stocking of new product behind the older, dated product. As a result, the shelf assemblies of the product display rack can be restocked in less time and with much less labor, which reduces labor costs and enables fewer delivery personnel to service a wider range of customers.

It will be understood by those skilled in the art that the foregoing relates only to preferred embodiments of the present invention, and numerous modifications, additions, and changes can be made to the present invention without departing from the spirit and scope of the invention ass et forth in the following claims.

Wherefore, the following is claimed:

1. A display assembly for supporting and displaying products, comprising:

upright stanchions spaced from one another each having an upper end and a lower end and a series of bores defined at spaced intervals along the length thereof;

a plurality of parallel shelf supports each comprising a substantially U-shaped rod having an open end adapted to engage and fit into said bores defined within said stanchions for mounting said shelf supports to said stanchions, a closed end opposite said open end and spaced upper and lower sections defining a guide along the length of each of said shelf supports, with said shelf supports projecting in a direction normal to the length of said stanchions; and shelf means having a first surface for supporting and displaying products and a second surface opposed from said first surface, said shelf means being slidably mounted on said shelf supports, said shelf means including guides positioned along said second surface in which said shelf supports are received to mount said shelf means on said shelf supports and to enable said shelf means to slide along said shelf supports a predetermined distance to provide access to said shelf means for efficient stocking of fresh products rearwardly of older products displayed on said shelf means.

2. The display assembly of claim 1 and wherein said shelf means comprises a substantially rectangular plate formed from an extruded plastic material.

3. The display assembly of claim 1, and further comprising means for fastening said shelf means to said shelf supports to prevent said shelf means from being removed from said shelf supports.

4. The display assembly of claim 1, and wherein said guides comprise pairs of downward depending flanges defining a channel therethrough.

5. The display assembly of claim 4, and wherein said means for fastening comprises pins extending through said flanges and through said shelf supports.

6. The display assembly of claim 1 and wherein said shelf means comprises a basket formed from wire.

7. The display assembly of claim 1 and wherein said shelf means further includes a series of receptacles adapted to receive and maintain products in aligned rows of products.

8. The display assembly of claim 1 and further including a display basket mounted adjacent said upper ends of said upright supports and having a series of tiers for supporting products at varying elevations.

9. A product display rack for supporting products in a series of aligned rows of the type including a series of upright stanchions having upper ends and lower ends and a plurality of mounting bores formed along their lengths at spaced intervals, and a plurality of shelf supports adapted to engage said mounting bores in a locking relationship with each shelf support of each stanchion substantially aligned with a shelf support of the other stanchion, the improvement therein comprising:

a plurality of product display shelves each slidably mounted upon a pair of aligned shelf supports at spaced elevations along said stanchions, each having an upper surface for supporting a series of products and a lower surface including guides positioned across the width of said display shelves and adapted to receive the shelf supports therein such that said display shelves are slidably mounted upon the shelf supports so as to enable said display shelves to be movable between a retracted display position and an extended stocking position to enable easy and efficient restocking of products on said display shelves, wherein the shelf supports each comprise a substantially U-shaped rod having an open end adapted to engage and fit into said mounting bores for mounting said shelf supports to said stanchions, a closed end opposite said open end and spaced upper and lower sections defining a guide slot along the length of each of said shelf supports.

10. The product display rack of claim 9 and wherein said product display shelves comprise substantially rectangularly shaped plates formed from an extruded plastic material.

11. The product display rack of claim 9 and wherein said product display shelves comprise metal wire baskets.

12. The product display rack of claim 9 and further including a series of partitions formed at spaced intervals along the length of each of said display shelves, forming troughs for stacking products in separate, aligned rows.

13. The product display rack of claim 9 and further including fasteners projecting through said guides and through said guide slots of the shelf supports to secure said display shelves to said shelf supports and limit the travel of said display shelves along the shelf supports by the engagement of one of said fasteners with said closed ends of the shelf supports.

14. A display assembly for supporting and displaying products, comprising:

upright stanchions spaced from one another each having an upper end and a lower end and a series of bores defined at spaced intervals along the length thereof;

a plurality of parallel shelf supports mounted to said stanchions and adapted to engage at least one of said bores of said stanchions in a locking relationship, with said shelf supports projecting in a direction normal to the length of said stanchions; and shelf means having a first surface for supporting and displaying products and a second surface opposed from said first surface, said shelf means being slidably mounted on said shelf supports, said shelf means including guides positioned along said second surface in which said shelf supports are received to mount said shelf means on said shelf supports and to enable said shelf means to slide along said shelf supports a predetermined distance to provide access to said shelf means for efficient stocking of fresh products rearwardly of older products displayed on said shelf means;

wherein said guides comprise pairs of downward depending flanges defining a channel therethrough; and wherein said display assembly further comprises pins extending through said flanges and through said shelf supports, said pins acting to fasten said shelf means to said shelf supports to prevent said shelf means from being removed from said shelf supports.

* * * * *